United States Patent [19]

King

[11] Patent Number: 4,615,661

[45] Date of Patent: Oct. 7, 1986

[54] MAGNETIC PUMP

[76] Inventor: Jimmy L. King, 416 Falcon Ct., Bedford, Tex. 76021

[21] Appl. No.: 802,933

[22] Filed: Nov. 26, 1985

Related U.S. Application Data

[63] Continuation of Ser. No. 402,065, Jul. 30, 1982, abandoned.

[51] Int. Cl.[4] ..... F04B 17/04; F04B 19/02

[52] U.S. Cl. ..... 417/418; 417/419; 417/466; 417/469; 417/505

[58] Field of Search ..... 417/410, 418, 419, 417, 417/538, 457, 460, 466, 469, 498, 542, 505; 310/34, 35, 50

[56] References Cited

U.S. PATENT DOCUMENTS

| | | | |
|---|---|---|---|
| 1,548,981 | 8/1925 | Clark | 417/538 |
| 2,004,161 | 6/1935 | Fausel | 417/466 |
| 2,605,042 | 7/1952 | Reutter | 417/417 |
| 2,659,847 | 11/1953 | Ezr | 310/35 X |
| 2,790,392 | 4/1957 | Schweiss | 417/417 |
| 3,492,819 | 2/1970 | Waltrip | 417/417 |
| 3,500,079 | 3/1970 | Barthalon | 310/30 X |
| 4,146,355 | 3/1979 | Bröker et al. | 417/457 |
| 4,150,922 | 4/1979 | Cuénoud et al. | 417/417 X |
| 4,170,439 | 10/1979 | Hase | 417/538 |
| 4,173,435 | 11/1979 | Hammelmann | 417/457 |
| 4,504,198 | 3/1985 | Toyoda et al. | 417/417 |

*Primary Examiner*—Cornelius J. Husar
*Assistant Examiner*—Peter M. Cuomo
*Attorney, Agent, or Firm*—James E. Bradley; H. Dennis Kelly

[57] ABSTRACT

A magnetic pump having a housing or block with three compartments and a port for supplying fluid into the center compartment. A pair of receivers are mounted in the center compartment and have check valves to allow fluid to flow into the receivers and outlets for conducting fluid out of the receivers. A sliding sleeve is mounted near each receiver and is reciprocal between two positions in which fluid is enclosed on one side of the receiver or the other. A piston assembly, mounted within each sleeve, is reciprocal to force the enclosed fluid from within the sleeve through the check valves into the receiver. The sleeves and the pistons are reciprocated electromagnetically. The cycle of the sleeves slightly preceeds the cycle of the pistons.

12 Claims, 15 Drawing Figures

MAGNETIC PUMP

This application is a continuation of application Ser. No. 402,065, filed July 30, 1982, now abandoned.

BACKGROUND OF THE INVENTION

1. Field of the Invention

This invention relates in general to the field of hydraulic pumps, and in particular to hydraulic pumps which utilize electromagnets in conjunction with permanent magnets to reciprocate a piston.

2. Description of the Prior Art

The magnetic pump of the invention is intended to be used in place of some conventional motors and engines. Pumps may have any number of pistons and cylinders. The parts of a pump may be made of light weight materials or cast from heavier materials. Magnets also may be made of various materials, ranging from low cost materials, such as soft iron, to high cost alloys. The more powerful magnets are made of alloys. The magnets used in magnetic pumps are made in many different shapes and work-done ratios. The electrical distribution systems in pumps may be mechanical or electrical.

SUMMARY OF THE INVENTION

The general object of this invention is to use electromagnetic forces to pump a fluid. This object is accomplished by a magnetic pump having a block, with a compartment and a port for supplying fluid into the compartment. A sliding sleeve is reciprocal between an open position, wherein the interior of the sleeve is in fluid communication with the compartment, and a closed position, wherein the sleeve becomes a receptacle which encloses a portion of the fluid in the compartment. A receiver within the compartment has a check valve to allow fluid to flow from within the receptacle into the receiver, and an outlet for conducting fluid out of the receiver. A piston is reciprocally mounted within the sliding sleeve to force fluid from within the receptacle through the check valve into the receiver. The sliding sleeve and the piston are reciprocated electromagnetically.

The above, as well as additional objects, features, and advantages of the invention, will become apparent in the following detailed description.

DESCRIPTION OF THE PREFERRED EMBODIMENT

Figure 1A:
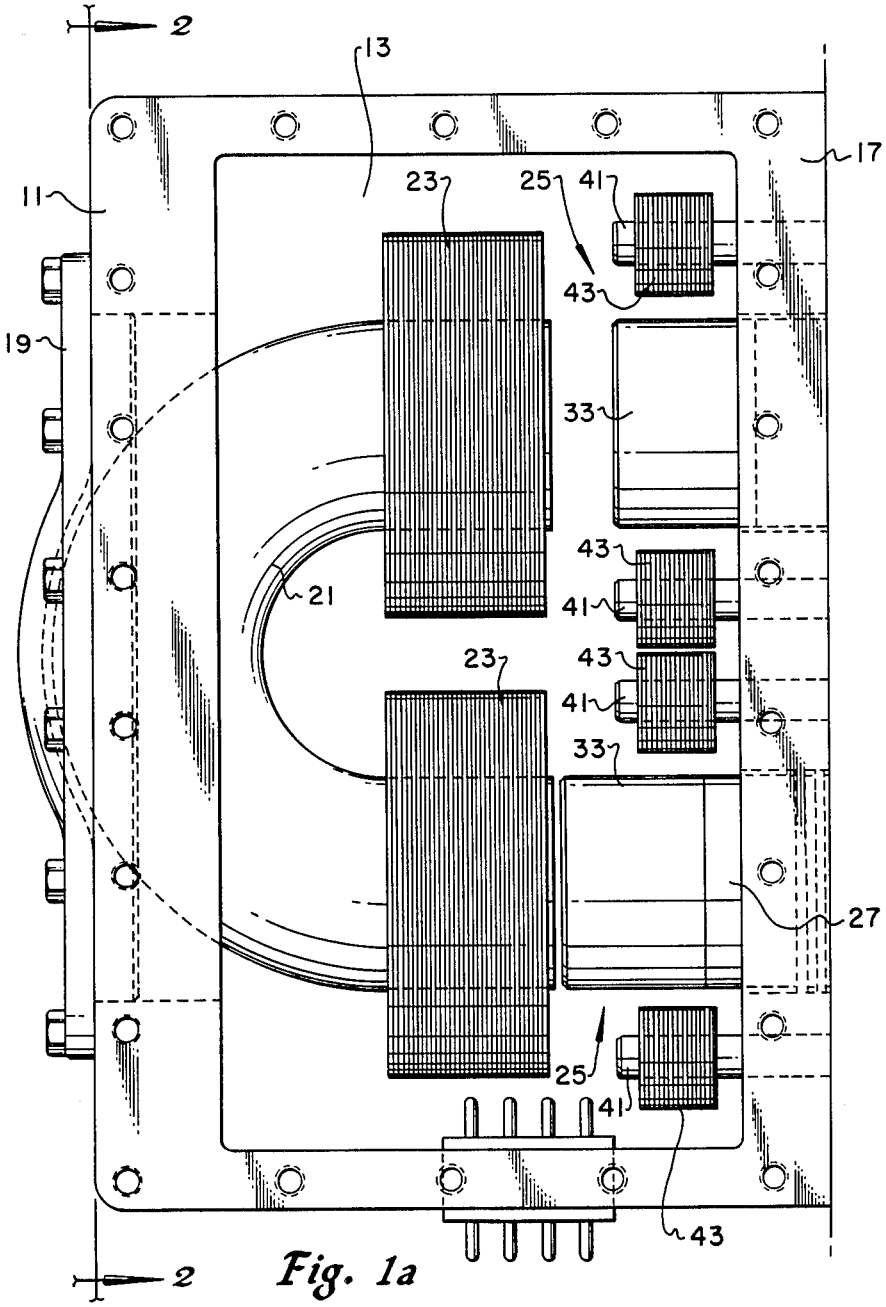
FIGS. 1*a*, 1*b*, and 1*c* are a top view of the magnetic pump of the invention.
Figure 1B:
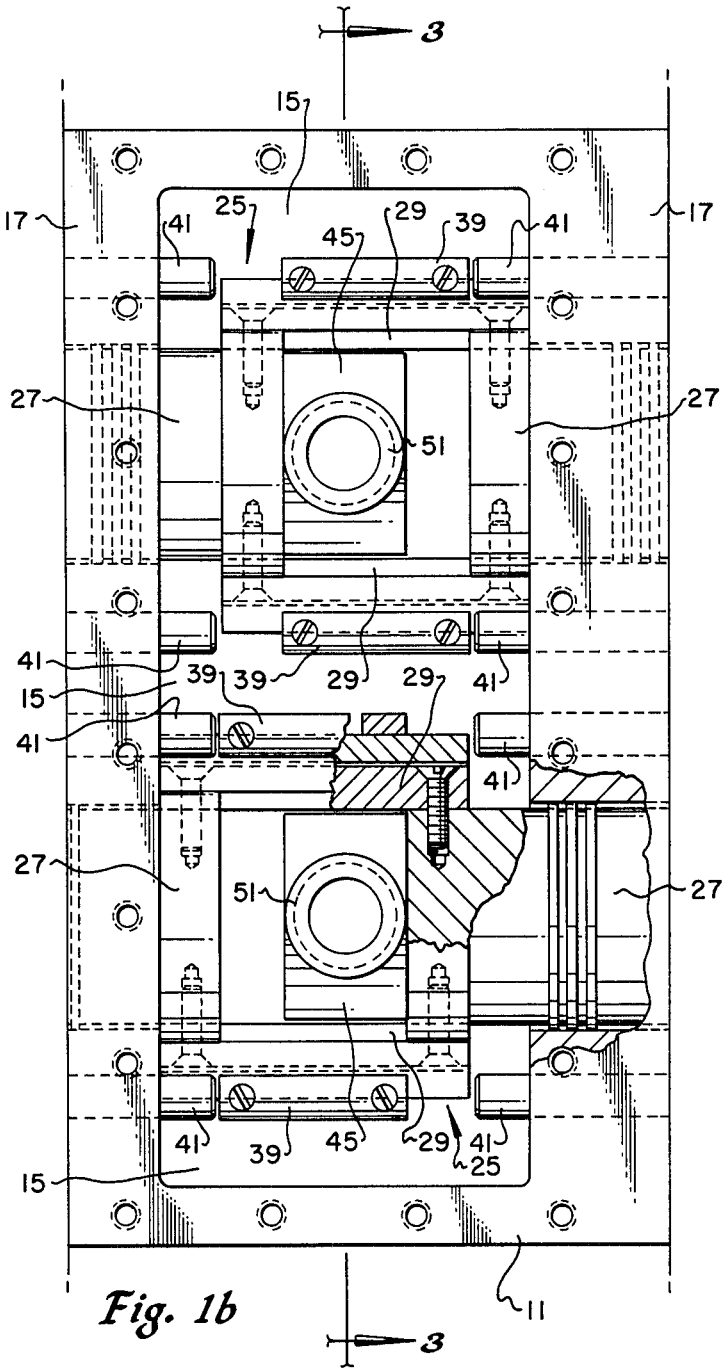
Figure 1C:
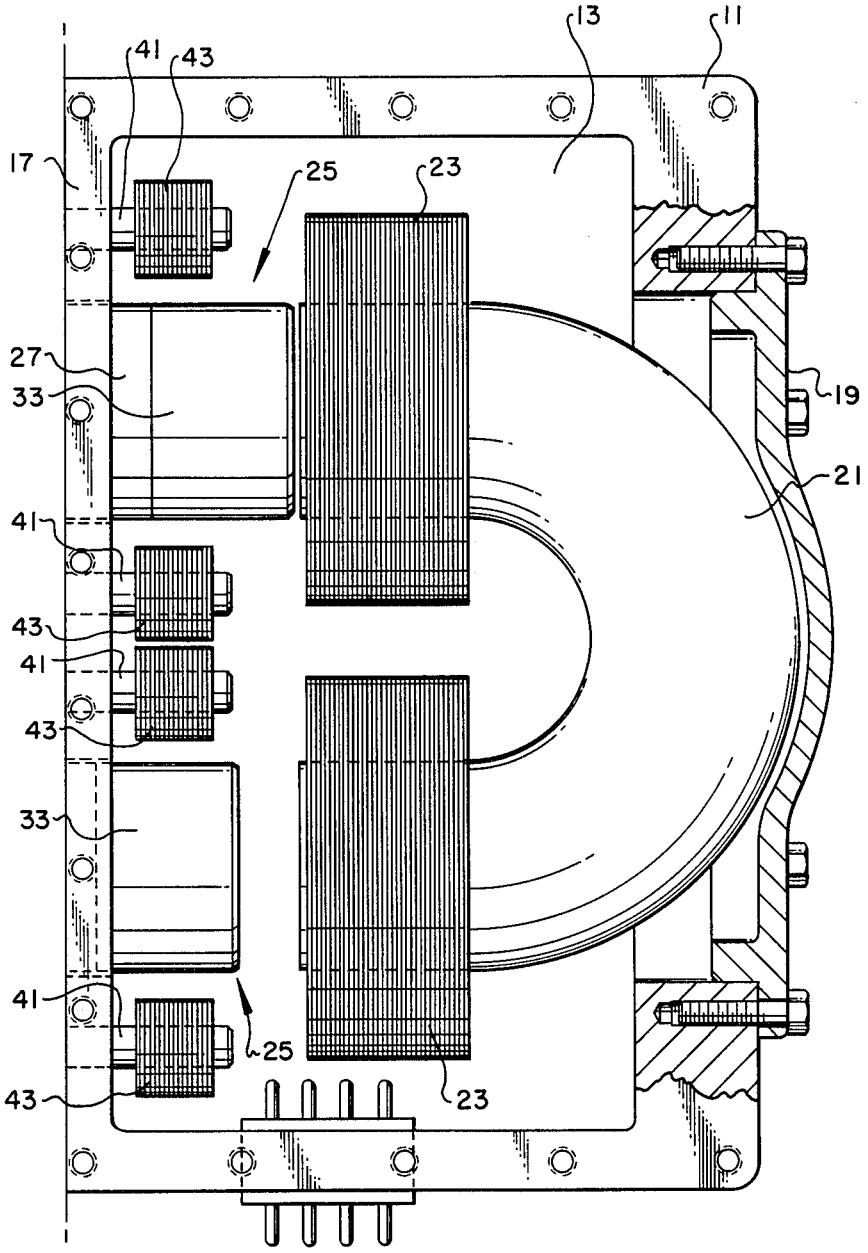

The preferred embodiment of the magnetic pump is enclosed in a housing or block 11, as shown in FIGS. 1*a*, 1*b*, and 1*c*. The block 11 may be made of light weight materials for portable units or of heavier materials for stationary units. The block has three inner compartments 13, 15. The two end compartments 13 (shown in FIGS. 1*a* and 1*c*) are dry compartments, and the center compartment 15 (shown in FIG. 1*b*) contains the fluid to be pumped. The compartments 13, 15 are separated by two partitions 17. A pair of plates 19 are securely bolted onto the block 11, one plate 19 on each end.

A large horseshoe electromagnet 21 is mounted in each end compartment 13. These electromagnets 21 may be soft iron or a more expensive alloy, depending upon the force needed. Large coils 23 are mounted around the ends of the horseshoe magnets 21. The attracting and repelling forces of the electromagnets 21 can be adjusted by varying the number of turns or the current in the coils 23.

Figure 4:
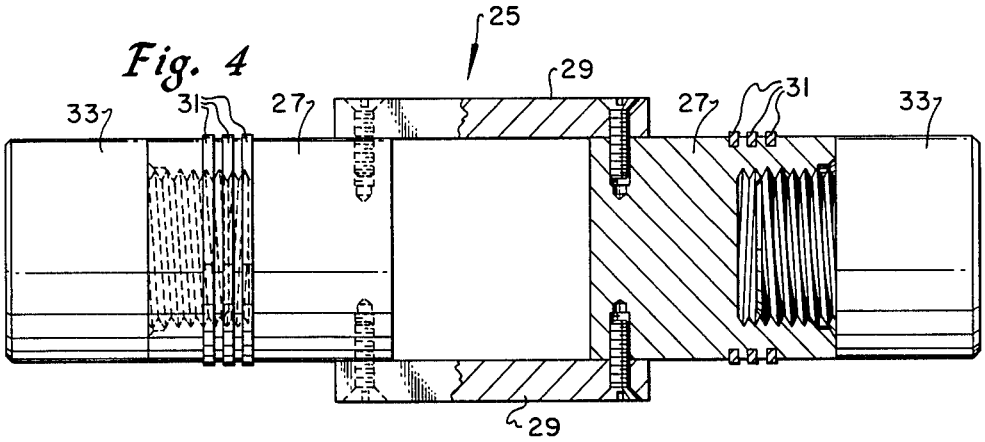
FIG. 4 is a top view of a piston assembly.

Between the opposing ends of the horseshoe magnets 21, and passing through the two partitions 17, are a pair of piston assemblies 25. One of these piston assemblies 25 is shown in detail in FIG. 4. Each assembly 25 has a pair of opposed pistons 27, connected by a pair of spacer bars 29. Each piston 27 has three piston rings 31: two high pressure rings and an oiler ring. The high pressure piston rings 31 have an overlapping joint, designed to prevent blow-by. A large, permanent magnet 33 is threaded onto each piston 27 to complete the piston assembly 25. As seen in FIGS. 1*a* and 1*c*, each permanent magnet 33 opposes one end of one of the horseshoe magnets 21. The horseshoe magnets 21 are an electromagnetic means for reciprocating the pistons 27 and piston assemblies 25.

Figure 7:
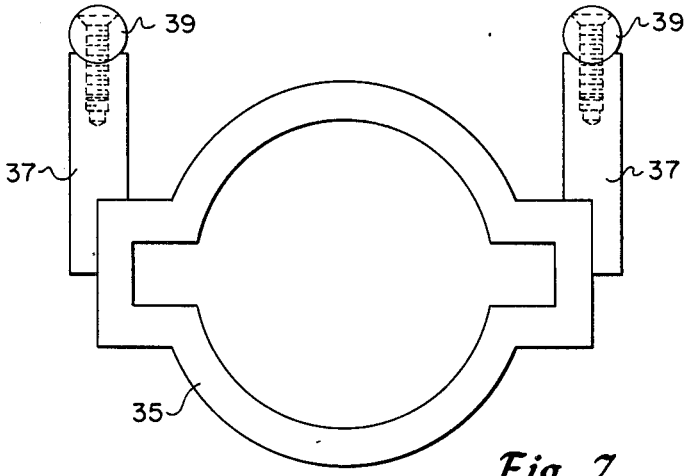
FIG. 7 is an end view of a sliding sleeve.

FIG. 7 illustrates a sliding sleeve 35, which slides along a piston assembly 25. The sliding sleeve 35 has a pair of upwardly extending arms 37, with a small permanent magnet 39 mounted atop each arm 37. These small permanent magnets 39 are also shown in FIG. 1*b*. At each end of each small permanent magnet 39 is a small electromagnet 41, energized by a small coil 43. These small electromagnets 41 are an electromagnetic means for reciprocating the sliding sleeve, and control the positions of the small permanent magnets 41 and the sliding sleeves 35.

Figure 2:
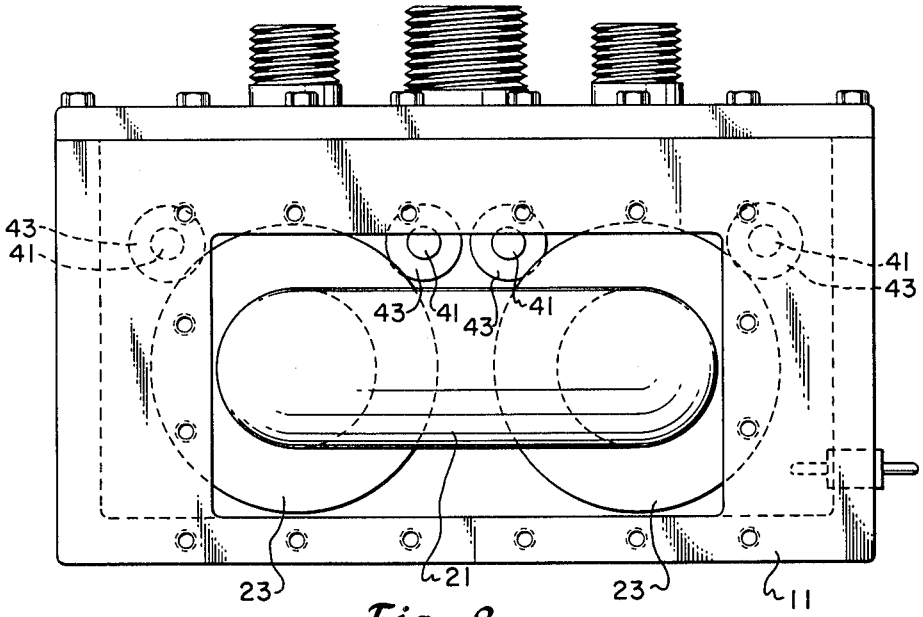
FIG. 2 is a sectional view as seen along line II—II in FIG. 1*a*.

FIG. 2 shows an end view of the magnetic pump, with the end plate 19 removed. In this view it can be seen that the small electromagnets 41 are located above and to either side of each piston assembly 25, which are aligned with each leg of the horseshoe magnet 21.

Figure 3:
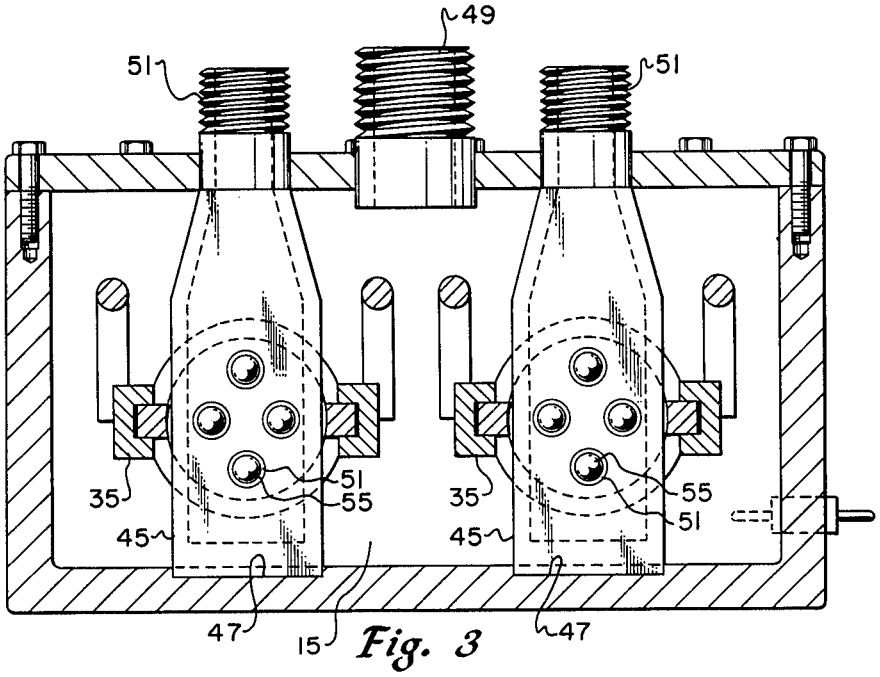
FIG. 3 is a sectional view as seen along line III—III in FIG. 1*b*.

FIGS. 1*b* and 3 show top and side views of receivers 45, which are mounted in recessed slots 47 in the center compartment 15. Each receiver 45 is located within a piston assembly 25, between the opposed pistons 27 and between the piston spacer bars 29. As seen in FIG. 3, the receivers 45 are located within the sliding sleeves 35. FIG. 3 also shows the fluid return port 49, which passes through the top of the block 11 into the center compartment 15, for supplying fluid into the center compartment 15.

Figure 5:
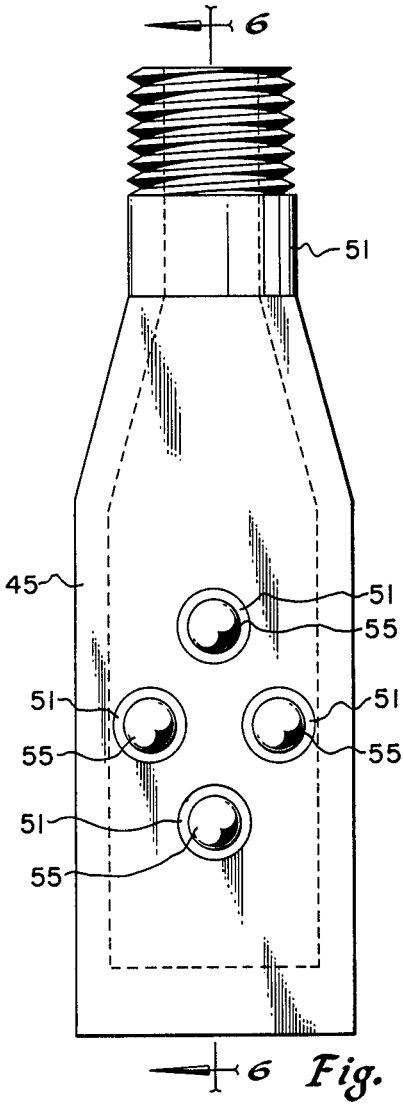
FIG. 5 is a side view of a receiver.
Figure 6:
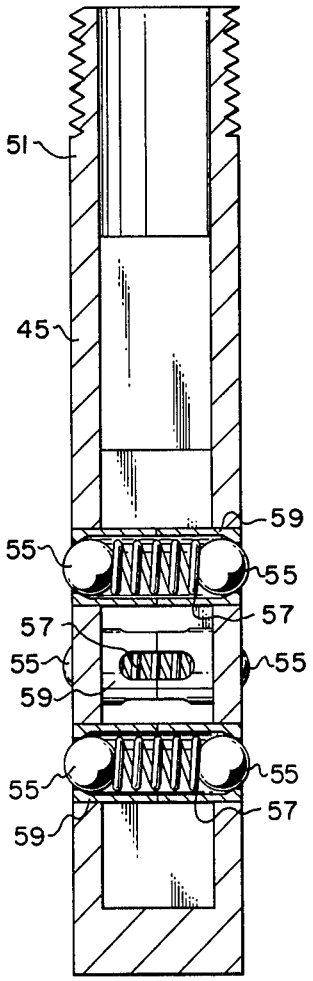
FIG. 6 is a sectional view as seen along line VI—VI in FIG. 5

The receivers 45 are shown in greater detail in FIGS. 5 and 6. Each receiver 45 has a neck 51, which extends through the top of the block 11, as shown in FIG. 3, and is means for conducting the fluid out of the receiver 45.

Each receiver 45 also has eight holes 53, four on each side, which open the interior of the receiver 45 to the center compartment 15. These holes 51 are normally closed by check valves, which consist of balls 55 and springs 57, held in place by clips 59.

Figure 8:
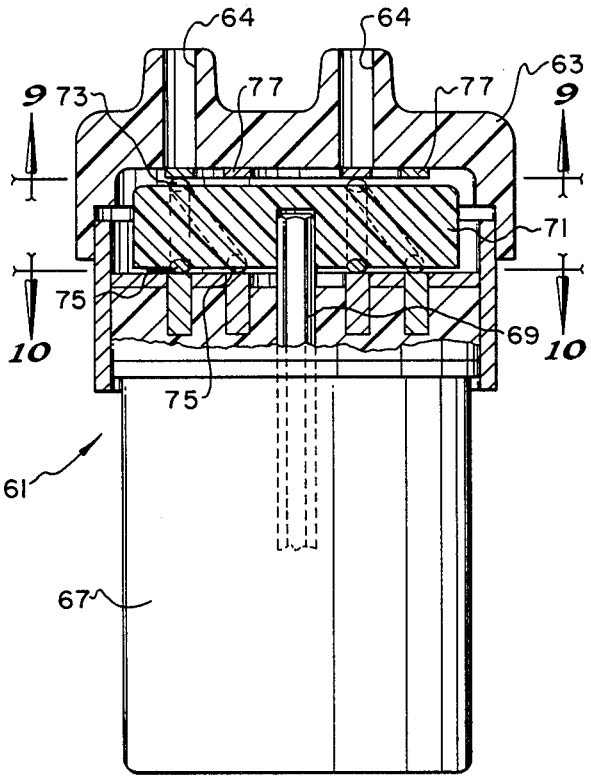
FIG. 8 is a sectional side view of the distributor.
Figure 9:
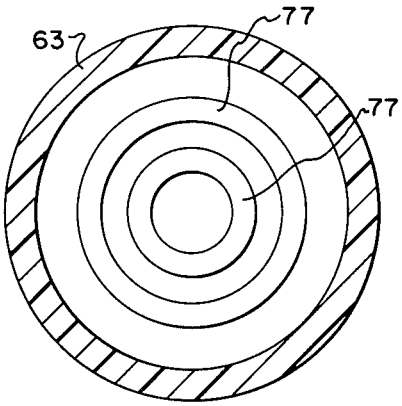
FIG. 9 is a sectional view as seen along line IX—IX in FIG. 8.
Figure 10:
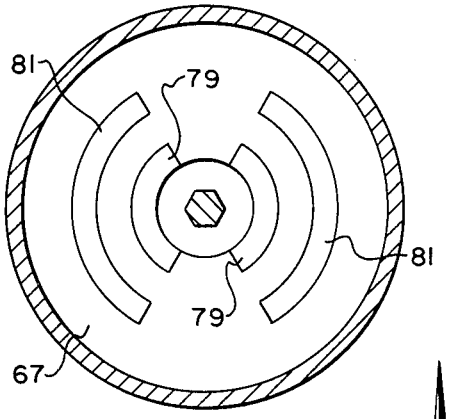
FIG. 10 is a sectional view as seen along line X—X in FIG. 8.

FIGS. 8–13 illustrate how the electrical current in the large coils 23 and the small coils 43 are alternated. FIG. 8 shows a motorized distributor 61. The disributor cap 63 has positive and negative connections 65, which are connected to a source of electricity 66, shown in FIG. 13. A motor 67 rotates a rotor 69 and a rotor arm 71 within the distributor 61. The rotor arm 71 has two upper contacts 73 and four lower contacts 75. The upper contacts 73 are in continuous contact with terminal strips 77, shown in FIG. 9, which are connected to the electrical connections 65, so one of the upper contacts 73 is always positive and the other is always negative.

Figure 11:
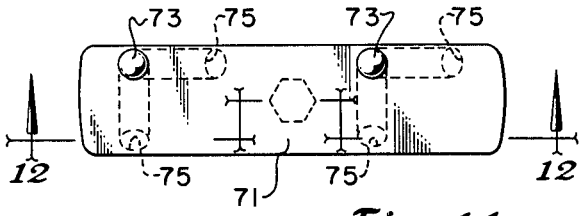
FIG. 11 is a top view of the rotor.
Figure 12:
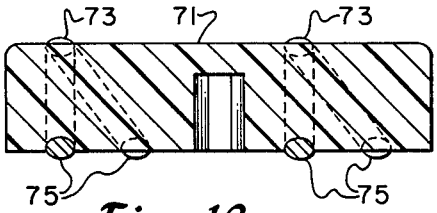
FIG. 12 is a side view of a rotor.

The lower contacts 75 are sometimes in contact with the lower terminal strips 79, 81. The inner lower terminal strip 79 is connected to the small coils 43, and the outer lower terminal strips are connected to the large coils 23. As the rotor arm 71 rotates, the positive electrical current alternates between the two inner lower terminal strips 79 and between the two outer lower terminal strips. The negative electrical current is similarly alternated. The lower contacts 75 are offset, as shown in FIG. 11, so that the current, whether positive or negative, is applied to the inner lower terminal strip 79 first. Current is thus applied to the small coils 43 slightly earlier than to the large coils 23. This causes the sliding sleeve 35 to begin moving prior to the piston assembly 25.

Figure 13:
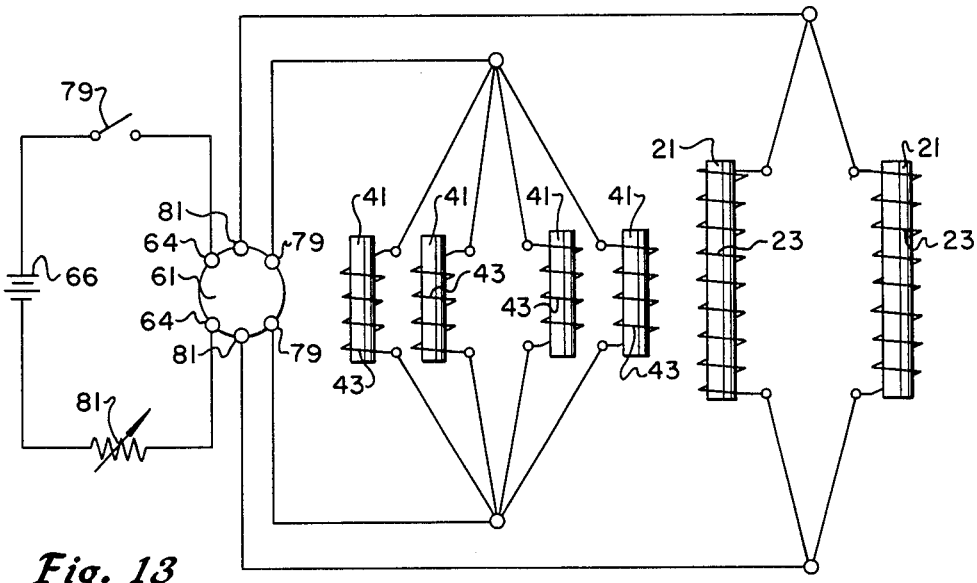
FIG. 13 is a schematic of the electrical circuit for the magnetic pump.

FIG. 13 is a schematic diagram of the electrical circuit for the pump. The electrical source 66 is connected through a switch 79 and a variable resistor 81 to the distributor 61. The distributor 61 distributes the positive and negative currents to the coils 23, 43 as explained above.

When the magnetic pump is in operation, the center compartment 15 is filled with fluid from the fluid return port 49. When the switch 79 is turned on, the distributor 61 begins sending alternating positive and negative current to the coils 23, 43. Current is first sent to the small coils 43 around the small electromagnets 41. The changed polarity of the small electromagnets 41 and the constant polarity of the small permanent magnets 39 cause the sliding sleeves 35 to slide in one direction. As the sliding sleeves 35 move, they close openings in the piston assemblies 35. The closed sliding sleeves 35 are receptacles which trap an amount of fluid between the receivers 45 and some of the pistons 27. The small electromagnets 41, which open and close the sliding sleeves 35, are a means for allowing fluid from the compartment 15 to flow into the receptacle without allowing fluid to flow out of the receptacle into the compartment 15.

Current is then sent to the large coils 23 around the legs of the horseshoe magnets 21. The changed polarity of the horseshoe magnets 21 and the constant polarity of the permanent magnets 33 cause the piston assemblies 25 to move in the same directions as the sliding sleeves 35. As the pistons 27 move through the sliding sleeves 35, fluid is forced into the receivers 45 through the holes 53.

The current in the small coils 43 is then reversed, forcing the sliding sleeves 35 to move in the opposite directions. The current in the large coils 23 is then reversed, and the piston assemblies 25 move in the opposite directions. As the current in the coils 23, 43 is alternated, the sliding sleeves 35 and the piston assemblies 25 cycle back and forth, pumping fluid into the receivers 45.

While the invention has been shown in only one of its forms, it should be apparent to those skilled in the art that it is not so limited, but is susceptible to various changes and modifications without departing from the spirit thereof.

I claim:

1. A magnetic pump, comprising:

a housing block, having a dry compartment and a fluid compartment for holding a fluid, wherein the compartments are separated by a partition;

a first electromagnet, mounted in the dry compartment;

a piston assembly, mounted for reciprocal movement toward and away from the first electromagnet, and passing through the partition;

a receiver, mounted in the fluid compartment;

wherein the receiver has a neck, which extends through the housing block, so that fluid can flow out of the receiver and out of the pump;

a check valve, on the side of the receiver facing the piston assembly, for allowing fluid to flow from the fluid compartment into the receiver, but not from the receiver into the fluid compartment;

a sliding sleeve, reciprocal between an open position, wherein the interior of the sleeve is in fluid communication with the fluid compartment, and a closed position, wherein the sleeve encloses a portion of the fluid in the fluid compartment;

a second electromagnet, which is not coaxial with the first electromagnet, for moving the sleeve reciprocally; and means for changing the polarity of the first and second electromagnets.

2. A magnetic pump, as recited in claim 1, wherein the piston assembly further comprises a piston and a first permanent magnet, wherein the first permanent magnet is on the end of the piston facing the first electromagnet.

3. A magnetic pump, as recited in claim 2, wherein the sliding sleeve has an arm, with a second permanent magnet on the end of the arm, aligned with the second electromagnet, and the second electromagnet reacts with the second permanent magnet on the arm to cause the arm and the sliding sleeve to move reciprocally.

4. A magnetic pump, as recited in claim 1, wherein the sliding sleeve has an arm, with a second permanent magnet on the end of the arm, aligned with the second electromagnet, and the second electromagnet reacts with the second permanent magnet on the arm to cause the arm and the sliding sleeve to move reciprocally.

5. A magnetic pump, comprising:

a housing block, having two end compartments and a center compartment, wherein the three compartments are separated by a pair of partitions;

a pair of first electromagnets, one electromagnet mounted in each end compartment, wherein one end of each electromagnet opposes one end of the other electromagnet; p1 a piston assembly, having a pair of opposed pistons, mounted for reciprocal movement between the opposing ends of the first electromagnets, and passing through the partitions;

a receiver, mounted in the center compartment;

wherein the receiver is located between the opposed pistons, and wherein the receiver has a neck, which extends through the housing block, so that fluid can flow out of the receiver and out of the pump;

a sliding sleeve, wherein the sleeve is reciprocal between an open position, wherein the interior of the sleeve is in fluid communication with the fluid compartment, and a closed position, wherein the sleeve encloses a portion of the fluid in the fluid compartment;

a check valve, on each side of the receiver facing a piston, for allowing fluid to flow from the center compartment into the receiver, but not from the receiver into the center compartment;

a plurality of second electromagnets, which are not coaxial with the first electromagnets, for moving the sleeve reciprocally; and means for changing the polarity of the first and second electromagnets.

6. A magnetic pump, as recited in claim 5, wherein the piston assembly further comprises a pair of first permanent magnets, wherein each first permanent magnet is on an end of a piston facing a first electromagnet.

7. A magnetic pump, as recited in claim 6, wherein the sliding sleeve has an arm, with a second permanent magnet on the end of the arm, aligned with one of the second electromagnets, and the second electromagnets react with the second permanent magnets to cause the arm and the sliding sleeve to move reciprocally.

8. A magnetic pump, as recited in claim 5, wherein the sliding sleeve has an arm, with a second permanent magnet on the end of the arm, aligned with one of the second electromagnets, and the second electromagnets react with the second permanent magnets to cause the arm and the sliding sleeve to move reciprocally.

9. A magnetic pump, comprising:

a housing block, having two end compartments and a center compartment, wherein the three compartments are separated by a pair of partitions;

a pair of horseshoe-shaped first electromagnets, one electromagnet mounted in each end compartment, wherein each end of each electromagnet opposes one end of the other electromagnet;

a pair of piston assemblies, each piston assembly having a pair of opposed pistons, mounted for reciprocal movement between opposing ends of the first electromagnets, and passing through the partitions;

a pair of receivers, mounted in the center compartment;

wherein each receiver is located between opposed pistons, and wherein each receiver has a neck, which extends through the housing block, so that fluid can flow out of the receiver and out of the pump;

a pair of sliding sleeves, wherein each sleeve is reciprocal between an open position, wherein the interior of the sleeve is in fluid communication with the fluid compartment, and a closed position, wherein the sleeve encloses a portion of the fluid in the fluid compartment;

a plurality of check valves, one on each side of a receiver facing a piston, for allowing fluid to flow from the center compartment into the receivers, but not from the receivers into the center compartment;

a plurality of second electromagnets, which are not coaxial with the first electromagnets, for moving the sleeves reciprocally; and means for changing the polarity of the first and second electromagnets.

10. A magnetic pump, as recited in claim 9, wherein each piston assembly further comprises a pair of first permanent magnets, wherein each first permanent magnet is on an end of a piston facing a first electromagnet.

11. A magnetic pump, as recited in claim 10, wherein each sliding sleeve has an arm, with a second permanent magnet on the end of the arm, aligned with one of the second electromagnets, and the second electromagnets react with the second permanent magnets to cause the arms and the sliding sleeves to move reciprocally.

12. A magnetic pump, as recited in claim 9, wherein each sliding sleeve has an arm, with a second permanent magnet on the end of the arm, aligned with one of the second electromagnets, and the second electromagnets react with the second permanent magnets to cause the arms and the sliding sleeves to move reciprocally.

* * * * *